United States Patent [19]

Lautenschläger

[11] Patent Number: 4,979,262

[45] Date of Patent: Dec. 25, 1990

[54] ROLLER FOR ROLLING DRAWER GUIDES

[75] Inventor: Horst Lautenschläger, Reinheim, Fed. Rep. of Germany

[73] Assignee: Karl Lautenschlager GmbH & Co. KG., Reinheim 1, Fed. Rep. of Germany

[21] Appl. No.: 403,598

[22] Filed: Sep. 6, 1989

[30] Foreign Application Priority Data

Sep. 6, 1988 [DE] Fed. Rep. of Germany ..... 3830214

[51] Int. Cl.[5] ..... A47B 88/04

[52] U.S. Cl. ..... 16/97; 16/107; 301/63 PW; 312/340; 312/341.1; 384/19; 384/22; 384/57; 384/58

[58] Field of Search ..... 16/18 R, 22, 23, 45, 16/46, 89, 97, 98, 100, 107, 91, 102, 106, 19; 301/63 PW; 312/340, 341.1; 384/19, 22, 57, 58; 403/357, 359, 372; 49/425

[56] References Cited

U.S. PATENT DOCUMENTS

| | | | |
|---|---|---|---|
| 3,418,869 | 12/1968 | Herpich | 16/107 |
| 3,874,748 | 4/1975 | Figueroa | 16/46 |
| 4,589,702 | 5/1986 | Bach et al. | 301/63 PW |
| 4,834,557 | 5/1989 | Dreinhoff | 384/57 |
| 4,863,288 | 9/1989 | Houck | 312/341.1 |

*Primary Examiner*—Richard K. Seidel
*Assistant Examiner*—Edward A. Brown

[57] ABSTRACT

Roller for rolling drawer guides with a wheel journaled on a stud (24) fastened to the running and/or guiding rail of the drawer guide, the wheel having a rim concentric with the longitudinal central axis of the stud (24). The wheel is divided into a hub (16) journaled on the stud (24) and a rim (18) disposed concentrically on the hub, and the rim (18) is mounted on the hub (16) for displacement in the direction of the roller axis of rotation. The rim (18) is held on the hub (16) preferably against rotation in the direction of rotation of the roller.

9 Claims, 2 Drawing Sheets

Fig. 2
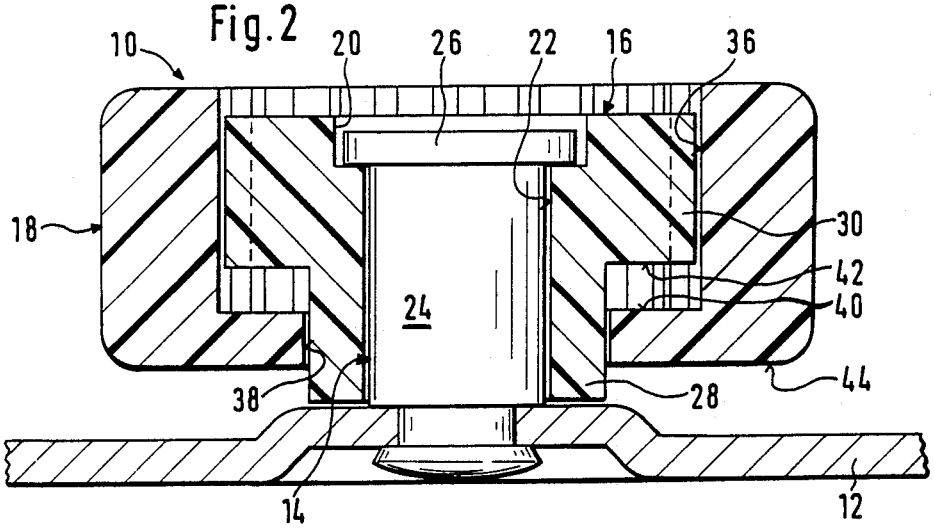
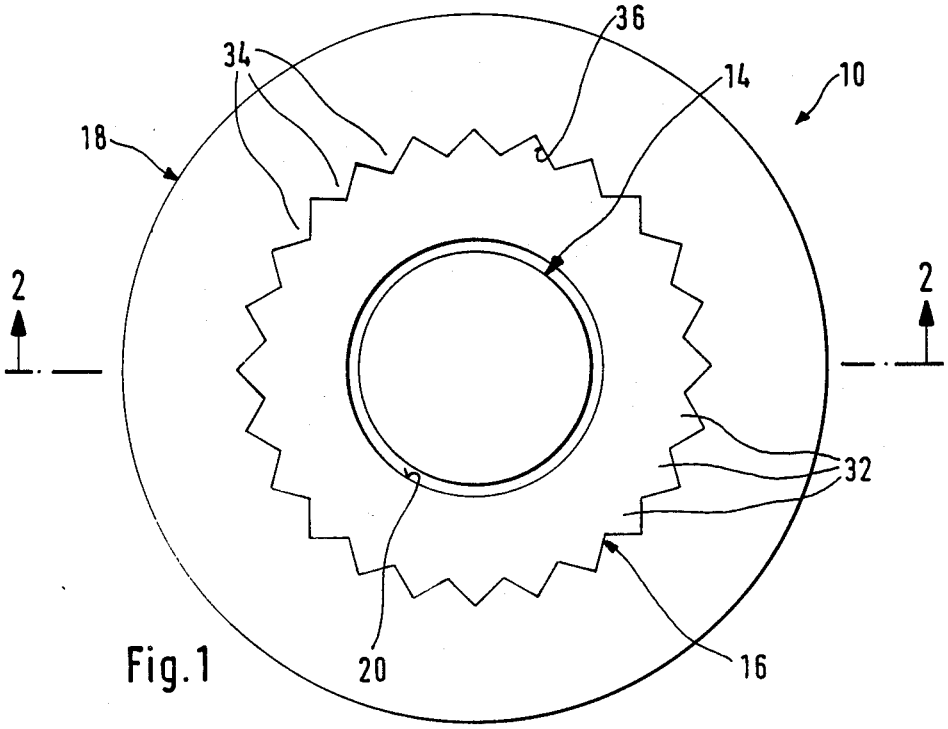
Fig. 1

Fig. 4
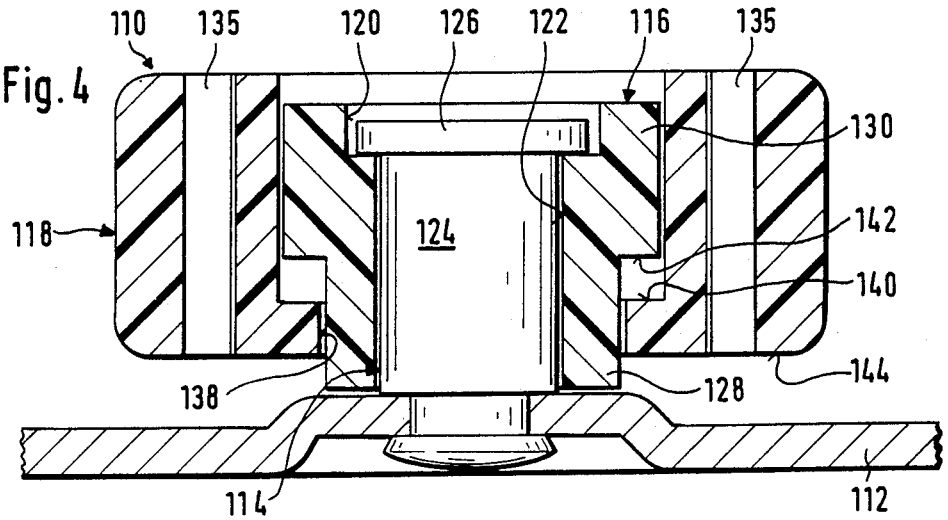
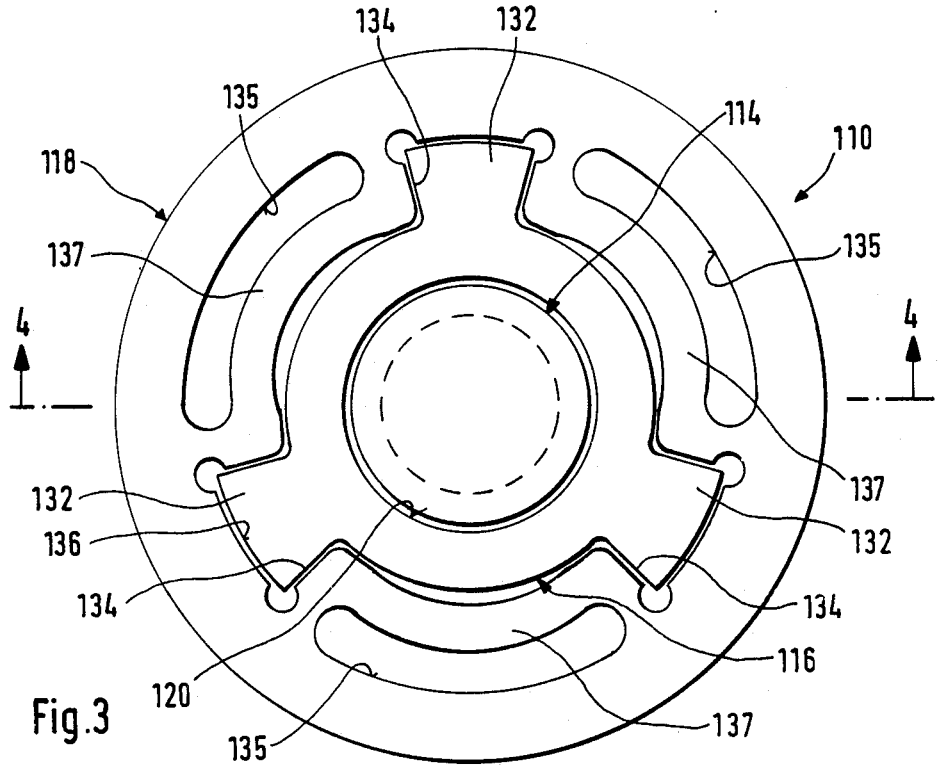
Fig. 3

ROLLER FOR ROLLING DRAWER GUIDES

BACKGROUND OF THE INVENTION

The invention relates to a roller for rolling drawer guides having a wheel rotatably mounted on a stud fastened to the running or guiding rail of the drawer slide, the tread of the wheel being concentric with the longitudinal central axis of the stud.

Rolling drawer guides have become increasingly popular in recent years for mounting drawers and other furniture parts drawably mounted in the carcass of a cabinet, because they run so easily, even when relatively heavily loaded. In the manufacture of furniture inaccuracies are constantly encountered in the widths of the drawers and in the internal distance between the supporting walls of the cabinet carcass. These inaccuracies do not impair the operation of conventional drawer guides, because at least one of the pair of drawer guides allows for adjustment of the resulting misalignments of the wheels on the associated rails, in which case, however, lateral displacements of the drawer transversely of the drawer movement direction are possible at least when such lateral displacements are possible on both drawer guides. It can then happen, for example, that the vertical edges of the exposed drawer fronts of several drawers arranged one over the other will no longer be in precise vertical alignment, resulting in an unattractive appearance. Furthermore, the lateral guidance of the drawer is poorer, becoming all the worse the further the drawer is pulled out. A drawer fully extended will have a free play that can be considerable on account of the then smaller distance apart of the wheels of the guiding rail and running rail. To eliminate this transverse play a linking of drawers with two different drawer guides on opposite sides of the drawers is known, and the portions of the cross sections of the rails of a drawer guide which are associated with the wheels are so configured that they still overreach the wheels, so that the lateral shifting of the wheels on their corresponding rails is at least greatly reduced. The inaccuracy of the width of the drawers or of the distance between the supporting walls of the cabinet then substantially affects the opposite drawer guide on which the portions of the cross sections overreaching the wheels are not provided. Aside from the fact that in this case drawer guides of different configuration must be used on opposite sides of the same drawer, it is not possible to use these known drawer guides in certain cases, e.g., when the drawer fronts of superimposed drawers must be precisely centered not only relative to one another but also as regards their position in the cabinet, because they do not permit the adjustment of the drawer transversely within the cabinet.

The invention is addressed to the problem of making it possible to use, on both sides of drawable furniture parts, the known drawer guides which have running rails and guiding rails overreaching the wheels, while nevertheless being able to compensate for inaccuracies in the width of the drawable furniture part or in the interior width of the cabinet, and at the same time to assure that the compensation will not result in a lateral misalignment of the drawable furniture part relative to the cabinet.

SUMMARY OF THE INVENTION

This problem is solved according to the invention, with the use of drawer guides unmodified as regards the running rails and guide rails, by the fact that the wheel body is divided into a hub mounted on the stud and a rim disposed concentrically on the hub, and that the rim is mounted for displacement on the hub in the direction of the axis of rotation of the wheel. Thus, it is possible to compensate certain inaccuracies of width by a lateral displacement of the rim relative to the hub. Thus it is possible to compensate for certain width tolerances by a lateral shift of the rim relative to the hub, in which case drawer guides having rails overreaching the wheels can be used on both sides, because the lateral shift of the rim relative to the hub of the particular wheels is possible on both sides. Therefore a precise centering of a drawer or of the drawer front in the cabinet is possible in the direction of the width.

At the same time it is possible to mount the rim on the hub so as to be unable to rotate on the hub, i.e., to permit displacement only in the transverse direction. To assure that a drawer mounted and centrally adjusted in a cabinet carcass by means of drawer guides having the wheel according to the invention will not be able to shift too easily due to external influences, provision is made in an advantageous development of the invention such that the bearing surfaces of the rim and/or of the hub which slide on one another when the rim is shifted transversely relative to the hub are friction-fitted to one another. The transverse adjustment of the drawable furniture part can then be performed only by a transversely acting adjusting force overcoming the friction between the hub and the rims of all of the wheels of both guides, which will not occur in the normal use of the drawer. That is to say, once an alignment of the drawer has been made it will be maintained, even though a further transverse adjustment will still be basically possible.

The mounting of the rim on the hub so as to be transversely displaceable but co-rotational therewith is best accomplished by a grooved joint, for example a spline coupling, which will assure that the rim will be held concentrically on the hub even when the drawable furniture part is heavily loaded.

Alternatively, the grooved joint can also be in the form of a multiple keyed coupling.

In the latter alternative it may be desirable to configure the keyways and the keys on the hub not with parallel flanks but with a dovetail-shaped cross section, the lateral walls of the grooves being resiliently biased against the flanks of the splines.

It is then desirable for at least the rim to be made from a resiliently adjusted plastic, the sections of the rim lying between adjacent keyways in the rim being configured as resiliently flexible walls and these walls can be made integrally from the material of the rim by piercing the rim with arcuate holes running through its entire width. Since the walls thus formed can yield resiliently into the arcuate holes when forces are exerted tending to force apart the sides of the keyways, it is possible to make the keyways in the rim narrower in width than the keys. Thus, when the rim is mounted on the corresponding hub, the sides of the keyways will then be forced apart such that the rim walls between them will flex resiliently. Thus the desired friction will be produced between the flanks of the hub keys and the sides of the keyways in the rim.

Aside from the matter of producing friction between the two parts of the wheel, it may be desirable to make the rim from a material with specific properties different from the corresponding properties of the material used for the hub, so as to achieve the quietest possible running noise when the wheel is rolling on the track of the associated guide rail or running rail. Suitable plastics are available for that purpose. Then, in addition to the previously described advantages, it will be possible also to achieve a considerable reduction of the noise the wheels make when the drawer is opened or closed, in comparison to metal wheels or wheels of very hard plastics.

BRIEF DESCRIPTION OF THE DRAWINGS

The invention will be further explained in the description that follows of two embodiments, in conjunction with the drawing wherein:

FIG. 1 is a side elevational view of a first embodiment of a wheel made in the manner of the invention, FIG. 2 is a cross section seen in the direction of arrows 2—2 in FIG. 1, FIG. 3 is a side view of a second embodiment of a wheel in accordance with the invention, and FIG. 4 is a cross section seen in the direction of arrows 4—4 in FIG. 3.

DESCRIPTION OF PREFERRED EMBODIMENTS

The wheel shown in FIGS. 1 and 2 and identified as a whole by the number 10 is rotatably mounted on a stud 24 projecting at right angles from the appropriate surface of the web 12 of the corresponding running or guiding rail to which it is riveted. The wheel 10 itself is composed of a hub 16 serving as the journal, and a rim 18 concentrically surrounding the hub. The hatching used in FIG. 2 for the surfaces of the section of the hub and rim indicates that the hub 16 and the rim 18 can both be made of plastics, although the plastics can have different properties in each case—for example for hub 16 a relatively hard plastic with good frictional and wearing properties with respect to its contact with the stud 24, and a softer plastic that damps noise when rolling on the track of an associated metal running rail or guide rail for the rim 18. It is to be noted that different materials can be used for the hub 16 and for the rim 18, such as metal in the one case and plastic in the other.

The hub 16 contains a journal bore 22 provided with a countersink 20 on the end remote from the web 12 of the corresponding rail. The length and diameter of the bearing bore 22, exclusive of the countersink 20, corresponds to the length and diameter of the actual journal section 14 of the stud 24 which has on its free end a flange 26 of larger diameter situated on its free end in the countersink 20, which retains the hub 16 on the stud 24.

Hub 16 itself has a section 28 of smaller diameter adjoining the web 12 of the corresponding rail, and it is adjoined by a section 30 of larger diameter on whose periphery teeth 32 are provided.

Complementary teeth 34 are provided in the rim 18 in a bore section 36 thereof, which is of a larger diameter, while the rim bore section 38 adjoining it on the web 12 side has a diameter reduced to approximately the diameter of the hub section 28. The depth of the bore section 36 containing the teeth 34, measured in the direction of the central axis of the stud 24, is greater than the width of the hub section 30 provided with the complementary teeth 32, so that the rim 18 can shift on the stud in the direction of the stud central axis, i.e., transversely of the direction of movement of an associated running or guiding rail. This shift is limited on one side by the radial surface 40 between bore sections 36 and 38 as well as the associated surface 42 between hub sections 28 and 30, and on the other side by the inner radial surface 44 of rim 18 facing the web 12, when it abuts against the latter.

The force necessary for a transverse shift of the rim 18 relative to the hub 16 is determined by the tightness of the fit between the complementary teeth 32 and 34.

The wheel 110 shown in FIGS. 3 and 4 differs from the wheel 10 described above in connection with FIGS. 1 and 2 only in regard to the manner in which the rim 118 is mounted on the hub 116 so as to be co-rotational therewith but transversely displaceable. To avoid repetition, therefore, only the differences between it and wheel 10 will be described hereinafter. Otherwise it will suffice to refer to the description of wheel 10, inasmuch as parts of wheel 110 performing the same functions as those of wheel 10 will bear the same reference numbers as in FIGS. 1 and 2, preceded by a number 1.

The teeth 32 and 34 of wheel 10 are replaced in wheel 110 by three wedge-shaped keys 132 projecting at equal angular intervals from hub section 130 into three corresponding keyways 134 in the larger-diameter opening 136 in the rim 118. The cross-sectional shape of the keys 132—differing in this regard from the parallel flanks of conventional keys—is such that their flanks run approximately radially, i.e., the wedge-shaped cross section flares from the inside out. The same then applies to the keyways 134 which, however, when the rim is not installed on the hub 116, are somewhat narrower in width than the keys 132, so that the rim can be mounted on the hub only if the lateral walls of keyways 134 can be widened resiliently. For this purpose arcuate through-holes 135 are provided in the rim 118, thus forming in the area between the keyways the walls 137 which flex resiliently into the holes 135 when the walls of the grooves are forced further apart. When the walls 137 are flexed by the installation of the rim on the hub they therefore develop a resilient restoring force which urges the walls of grooves 134 against the flanks of the wedges 132.

I claim:

1. A roller for a running or guide rail of a drawer guide of a piece of furniture, comprising: a stud to be mounted to the rail and having a central axis; and a wheel; said wheel having a hub mounted on the stud so as to be rotatable about said central axis, and also having a rim mounted on the hub so as to be non-rotatable with respect to the hub but displaceable relative to the hub in the direction of the central axis.

2. A roller according to claim 1, wherein the rim and hub have bearing surfaces which are slidable one on the other under slight pressure.

3. A roller according to claim 2, wherein said hub and said rim have multiple groove connections so as to be displaceable axially but non-displaceable circumferentially with respect to each other.

4. A roller according to claim 3, wherein the multiple groove connection forms a spline-shaft coupling.

5. A roller according to claim 3, wherein the multiple groove connection is a multiple key coupling.

6. A roller according to claim 5, wherein the key coupling has keys on the hub and keyways on the rim, said keys and keyways having complementary dovetail-shaped cross sections, said keyways having sides biased against flanks of the keys.

7. A roller according to claim 6, wherein at least the rim consists of a resilient plastic, and wherein the rim has sections between the sides of adjacent keyways, said sections being resiliently flexible walls.

8. A roller according to claim 7, wherein the walls are formed by arcuate cut-outs extending through the rim.

9. A roller according to claim 1, wherein the hub and the rim consist of different materials, the material of the rim having noise reducing qualities.

* * * * *